US005499961A

United States Patent [19]

Mattox

[11] Patent Number: 5,499,961

[45] Date of Patent: Mar. 19, 1996

[54] KNEELING-PRONE-KNEELING EXERCISE DEVICE

[76] Inventor: Ernest M. Mattox, 1640 Leonard St., NW., Grand Rapids, Mich. 49504

[21] Appl. No.: 169,674

[22] Filed: Dec. 17, 1993

[51] Int. Cl.[6] ..... A63B 21/04; A63B 21/055

[52] U.S. Cl. ..... 482/132; 482/123; 482/135

[58] Field of Search ..... 482/49, 51, 121–125, 482/129, 130–135, 139, 148, 907, 145

[56] References Cited

U.S. PATENT DOCUMENTS

| | | | |
|---|---|---|---|
| 3,707,284 | 12/1972 | Waldeck | 482/130 |
| 5,201,866 | 11/1993 | Mattox | 482/132 X |
| 5,224,909 | 7/1993 | Hamilton | 402/51 X |

FOREIGN PATENT DOCUMENTS

| | | | |
|---|---|---|---|
| 2160433 | 12/1985 | United Kingdom | 482/148 |

*Primary Examiner*—Richard J. Apley
*Assistant Examiner*—John Mulcahy
*Attorney, Agent, or Firm*—Varnum, Riddering, Schmidt & Howlett

[57] ABSTRACT

An improved exercise device which is adjustable for users of different size and muscle capability. The device comprises a wheel rotatably mounted on an axle, a pair of handgrips telescopically mounted on the axle, and a length of elastic robing telescopically mounted on the opposite ends of the axle. Pads for a user's knees, and a padded purchase for the user's ankles are also provided. In one embodiment, the knee pads are adjustably mounted on the elastic tubing. In an alternative embodiment, the elastic rubing, knee pads and ankle purchase adjustably affix to a common frame. The user kneels on the pads, grips the handgrips, and rolls the wheel and axle forward, away from the pads until the user is in the prone position. Thereafter, the user rolls the axle and wheel backward, until the starting position is reached. A stop can be provided for limiting forward movement of the roller.

20 Claims, 8 Drawing Sheets

KNEELING-PRONE-KNEELING EXERCISE DEVICE

BACKGROUND OF THE INVENTION

1. Field of the Invention

This invention relates to an exercise device and, more particularly, to an exercise device having a knee rest and a heel brace to assist in an exercise in which one extends from a kneeling position to an extended position.

2. Description of Related Art

There are numerous exercises which an individual may practice to strengthen muscles and maintain muscle tone. The Royal Canadian Air Force has a well-known exercise regimen with several different exercises required. One of the exercises of this regimen requires a person to start in a kneeling position on his hands and knees, then push his body forward, sliding out along his hands with his arms rigid. The exerciser continues pushing forward until in the prone position with arms extended out beyond head and shoulders and hips lowered to the floor. Then, the exerciser returns to the kneeling position by reversing the sliding action. As one can imagine, this is a very difficult exercise especially for an individual who is not in good physical condition.

The movement of the exercise described above is beneficial for the exerciser's arms, shoulders, upper back, and abdominal muscles. In light of this, others have created exercise devices which assist the exerciser in completing the kneeling-prone-kneeling movement through the use of a biased, wheeled exercise device. For example, the German Patent Applications Offenlegungsschrift No. 2,029,451 to Neubert published Dec. 2, 1971 and No. 2,017,216 to Buchmann published Oct. 28, 1971 disclose wheeled exercise devices which assist the exerciser in the kneeling-prone-kneeling movement described above. In each of these references, the user grasps an axle which rotatably supports one or more wheels. The user hooks his or her feet into stirrups which are connected to the axle by one or more springs or pieces of elastic. The user can push forward from a kneeling position to the prone position by rolling the wheel away from his knees. This movement is resisted by the springs which extend between the wheel and the user's feet.

Tolchin U.S. Pat. No. 1,984,165, issued Dec. 11, 1934 discloses a similar kneeling/prone/kneeling exercise device which incorporates a pair of fixed knee pads which are mounted adjacent a guide rail upon which a trolley rides. The user kneels on the pads, grasps the handle bars of the trolley, and extends forward from the kneeling to the prone position and returns to the kneeling position. A compression spring biases the trolley toward the knee pads.

Another exercise device of this type is disclosed in the Ott U.S. Pat. No. 3,752,475, issued Aug. 14, 1973. Ott describes a wheel rotatably mounted on an axle with a spring or other bias means mounted between the wheel and axle and which resists rotation of the wheel relative to the axle. Therefore, as the user grasps the axle and rolls the device forward, the rotation of the wheel is resisted by the spring bias.

Unfortunately, the exercise devices described above have several significant drawbacks. First, the Neubert, Buchmann, and Ott devices provide no padding for the user's knees. Therefore, use of the device even on a carpeted floor is quite painful for the user's knees. While the Tolchin apparatus does disclose pads for the knees, these pads are fixed with respect to the moving trolley and not adjustable, thereby limiting the usefulness of the device for persons of different size and condition.

Each of the devices discussed above incorporate hooks, straps, stirrups and other attachment means which could easily injure the user. For example, if the user is extended to the fully prone position, the springs of the various devices will be stretched a large amount and exert a large amount of force on the hooks and connections between the springs and the connection to the axle and stirrups. If one of these connections or hooks were to fail under this load, both the failed hook and the spring would become projectiles and could injure the user. Therefore, the elimination of these hooks and interconnections enhances the safety of the product.

Also, the kneeling-prone-kneeling exercise tends to emphasize the muscles of the anterior trunk over those of the posterior trunk and legs. Many people desire to strengthen the muscles of their trunks to support and stabilize their spines. Weak and undertoned trunk musculature often leads to strained back muscles and can lead to increased stress and injury to the disks in the spine between the vertebrae. Well-toned trunk muscles support the spine and help to prevent such injury.

Proper conditioning of the trunk muscles to support the spine requires muscle strength balance; the strength of the many muscles in the trunk must be balanced in order to prevent one or more of the muscles from overpowering and injuring complementary trunk muscles. Many exercises and exercise devices strengthen the abdominal muscles; however, exercising the back muscles without putting undue strain on those muscles is a difficult task. Most exercise devices for exercising the back muscles are bulky, expensive, and suitable only for use at a gymnasium or other facility under proper supervision.

One attempt to design a relatively inexpensive and simple back exerciser is illustrated in the Hall U.S. Pat. No. 5,205,804, issued Apr. 27, 1993. The Hall patent discloses a padded platform having a central, upwardly extending protrusion. A pair of spaced apart rails extend longitudinally from one end of the platform. Parallel, padded ankle and heel bars are elevated slightly above the opposite end of the platform and extend transverse thereto with the heel bar disposed above the ankle bar. An exerciser locks his or her ankles between the padded bars, places his or her abdomen upon the protrusion, and hands upon the rails. By dipping the torso below the rails and then raising the torso above the rails, the exerciser works muscles in the back, legs, and arms. At the exerciser's discretion, the weight load can be redistributed between the back muscles and the arm muscles by reducing or increasing the load supported by the arms.

Unfortunately, the Hall exercise device provides little or no exercise for the abdominal muscles and is not adjustable to limit the stress upon the back muscles. Also, the Hall exercise device is somewhat bulky due to the large vertically extending protrusion for supporting the exerciser's abdomen.

These prior devices, as illustrated above, do not provide balanced exercise for hamstring, quadriceps, gluteus and lower back muscles. Also, most do not support the lower back during the exercise.

SUMMARY OF THE INVENTION

An exercise device according to the invention overcomes the problems of the prior art devices by incorporating interrelated knee rests and a heel brace and thus supporting the low back while exercising muscles of the legs and lower back. Also, the exercise device of the present invention provides improved muscle strength balance between the upper and lower body from a single exercise.

An exercise device according to the invention comprises a glide for supporting arms of a user in a forward kneeling position, whereby the user may glide along a support surface while extending his or her body in a forward direction. A heel brace is provided for restraining upward movement of the user's heels, and a knee rest is provided for supporting the user's knees, both while the user is in a forward kneeling position and while the user is gliding the glide along the support surface. A connector between the knee rest and the heel brace maintains the heel brace and the knee rest in a relatively fixed position, at least while the user rests his or her knees upon the knee rest. As the user glides in the forward direction with knees on the knee rest and heels abutting the heel brace, the user can use at least one of the muscle groups of the back, buttock, and legs to extend the body and return the body to the kneeling position and pressure against the heel brace provides support for muscles in the lower back while performing the exercise.

Preferably, a biasing element is provided between the glide and the connector to resist the movement of the glide in the forward direction, and to assist the user in returning to the forward kneeling position. The biasing element is preferably an elastic band, typically in the form of rubber tubing, and the glide preferably comprises a wheeled roller. The biasing member is preferably adjustably connected to the connector to accommodate different size users and different exercise requirements. Positional adjustment is preferably provided between the knee rest and heel brace to accommodate users of different sizes. In one embodiment of the invention, the knee rest comprises pads resting atop a plate which forms a part of the connector. In another embodiment of the invention, the knee rest comprises spaced apart forward and rearward bars extending laterally from the connector, with cylindrical pads received upon the bars.

Preferably, the heel brace comprises a vertical riser and a horizontally oriented heel receiving bar on the riser so that the heel receiving bar is above the support surface area. To this end, the riser has a vertical adjustment member to selectively raise and lower the heel receiving bar with respect to the support surface. The connector preferably comprises a frame member which extends laterally from the riser and the knee rests are adjustably mounted on the frame member.

In one embodiment of the invention, the heel brace comprises a vertical riser, a horizontally oriented heel receiving bar on the riser so that the heel receiving bar is above the support surface and cylindrical pads mounted on the heel receiving bar to provide comfort to the heels of the user. Further, the knee pads comprise spaced apart front and rear bars, each of the front and rear bars being affixed to the connector and extending laterally therefrom, and cylindrical pads received on the front and rear bars whereby the user's knees can be received atop the pads and between the front and rear bars while the user is in a forward kneeling position and rolling the roller along the support surface in a forward or rearward direction.

In accordance with one embodiment of the invention, a handrail is affixed to the connector and has a gripping portion elevated above the support surface so that a user can grasp the handrail and ease his or her entry into the forward kneeling position on the knee rest. Further, according to a preferred embodiment of the invention, the connector comprises an elongated bar extending forwardly of the knee rest and further comprises an adjustable stop member adjustably mounted on the elongated bar for limiting forward movement of the glide. A user can thus affix the stop member in a position to limit his or her forward movement short of a fully prone position and thereby reduce stress upon muscles in the back.

In a further aspect of the invention, an exercise device according to the invention comprises a heel brace to restrain upward movement of the heels of a user in a forward kneeling position and as the user moves his or her torso forwardly and rearwardly. A knee rest supports knees of a user in a forward kneeling position as the user moves his or her torso forwardly and rearwardly. A connector between the knee rest and the heel brace maintains the heel brace and the knee rest in a relatively fixed position, at least while the user rests his or her knees on the knee rest and moves his or her torso forwardly and rearwardly. The user can perform an exercise in which, starting from a forward kneeling position with knees on the knee rest and heels abutting the heel brace, the user moves his or her torso forwardly toward a prone position and then returns to the forward kneeling position.

A method for performing an exercise for a human body according to the invention comprises the steps of: placing the body into a forward kneeling position with knees on a supporting surface; bracing heels of the body underneath a heel brace and thereby restraining the heels against upward movement; extending a torso of the body forwardly towards a prone position while supporting the body upon the knees and against the heel brace; and returning the body's torso to the forward kneeling position while supporting the body upon the knees and against the heel brace. Forward and return movement of the torso while supporting the body upon the knees and against the heel brace exercises muscles in at least one of the body's legs, buttocks and back.

BRIEF DESCRIPTION OF THE DRAWINGS

The invention will now be described with reference to the drawings wherein.

DESCRIPTION OF THE PREFERRED EMBODIMENT

Figure 2:
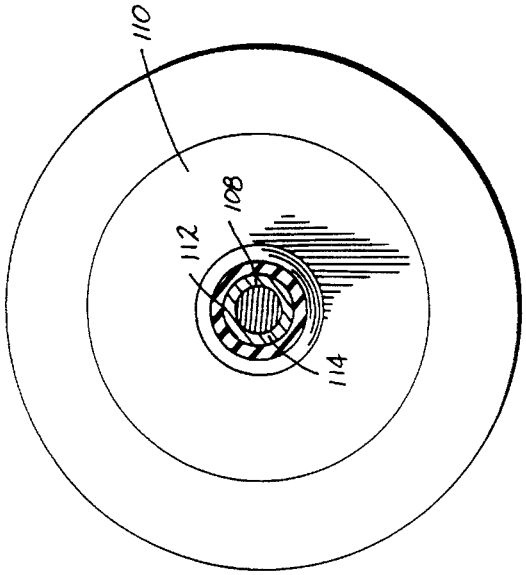
FIG. 2 is a cross-sectional view of an axle of a wheeled roller of the exercise apparatus of FIG. 1 taken along line 2—2 of FIG. 1.
Figure 1:
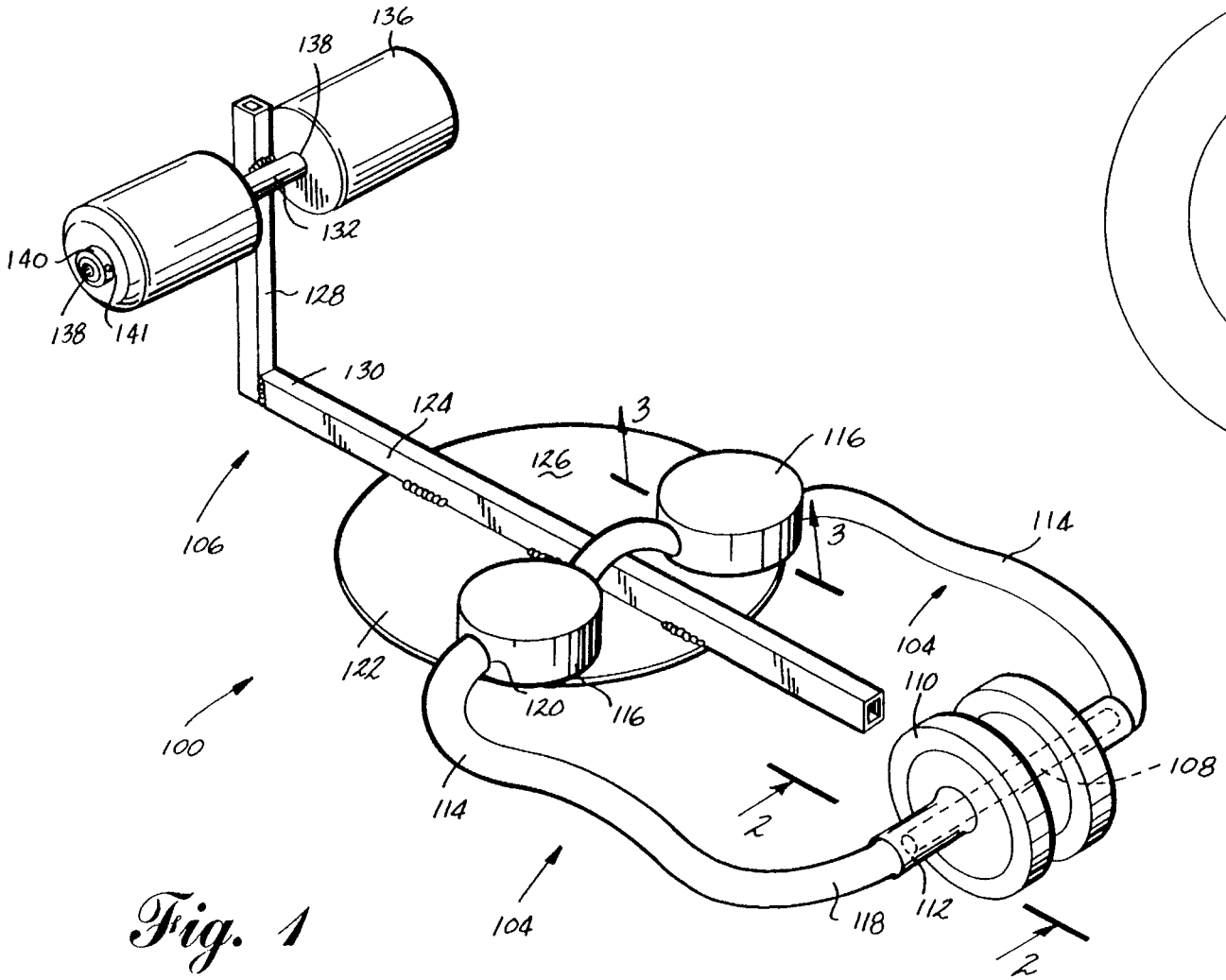
FIG. 1 is a perspective view of a first embodiment of an exercise apparatus according to the invention.

Turning now to the drawings, and primarily to FIG. 1, a first embodiment of an exercise apparatus 100 according to the invention comprises a heel brace assembly 106. A separate wheeled roller assembly 102 having an elastic member 104 attached thereto is also provided. The wheeled roller comprises an axle 108 having a double wheeled wheel member 110 rotatably mounted upon a central portion of the axle and a pair of hand grips 112 on opposite ends of the axle 108. The elastic member 104 comprises a length of elastic tubing 114 carrying a pair of knee pads 116 and having two ends 118. The ends of the tubing 118 are telescopically mounted on the ends of the axle 108, with the hand grips 112 telescopically mounted over the tubing ends 118 and axle 108. The knee pads 116 each have a channel 120 through which the elastic tubing 114 passes.

Preferably, the elastic tubing 114 is hollow latex tubing with an internal diameter less than the outer diameter of the axle 108. One end of the tubing 114 is telescopically mounted on the axle 108 by lubricating the axle 108 with an agent which will quickly evaporate so that the tubing 114 may not be easily removed from the axle 108 once it is mounted thereon. The preferred agent for mounting the tubing 114 on the axle 108 is rubbing alcohol. The alcohol quickly evaporates after the tubing 114 is mounted on the axle 108, it leaves no residue, and when used in limited amounts will not affect the properties of the tubing 114.

The heel brace assembly 106 comprises a large, flat, horizontally disposed, circular base plate 122 having an elongated horizontal bar 124 affixed to and bisecting an upper surface 126 of the base plate 122. The horizontal bar 124 extends beyond the base plate 122 in both directions, and a vertical bar 128 extends upwardly from a rear end 130 of the horizontal bar. A heel bar 132 is affixed near an upper end 134 of the vertical bar 128, and extends horizontally, outwardly transverse to the horizontal bar 124. A pair of cylindrical pads 136 are mounted to the heel bar 132, thereby providing a comfortable engagement surface for a user's heels. Channels 138 extend coaxially through each pad 136 for telescopically receiving the ends of the heel bar. The pads 136 cay be simply glued on to the heel bar 132 or be retained thereon by collects 140 received upon the ends of the heel bar 132. Preferably, the collets 140 are retained upon the ends of the heel bar 132 by means of a set screw 141. The heel bar 132 is oriented relative to the base plate 126 so that a user can place his or her knees upon the base plate 122, and while keeping his or her calves essentially horizontal lock his or her heels underneath the heel bar 132.

Figure 3:
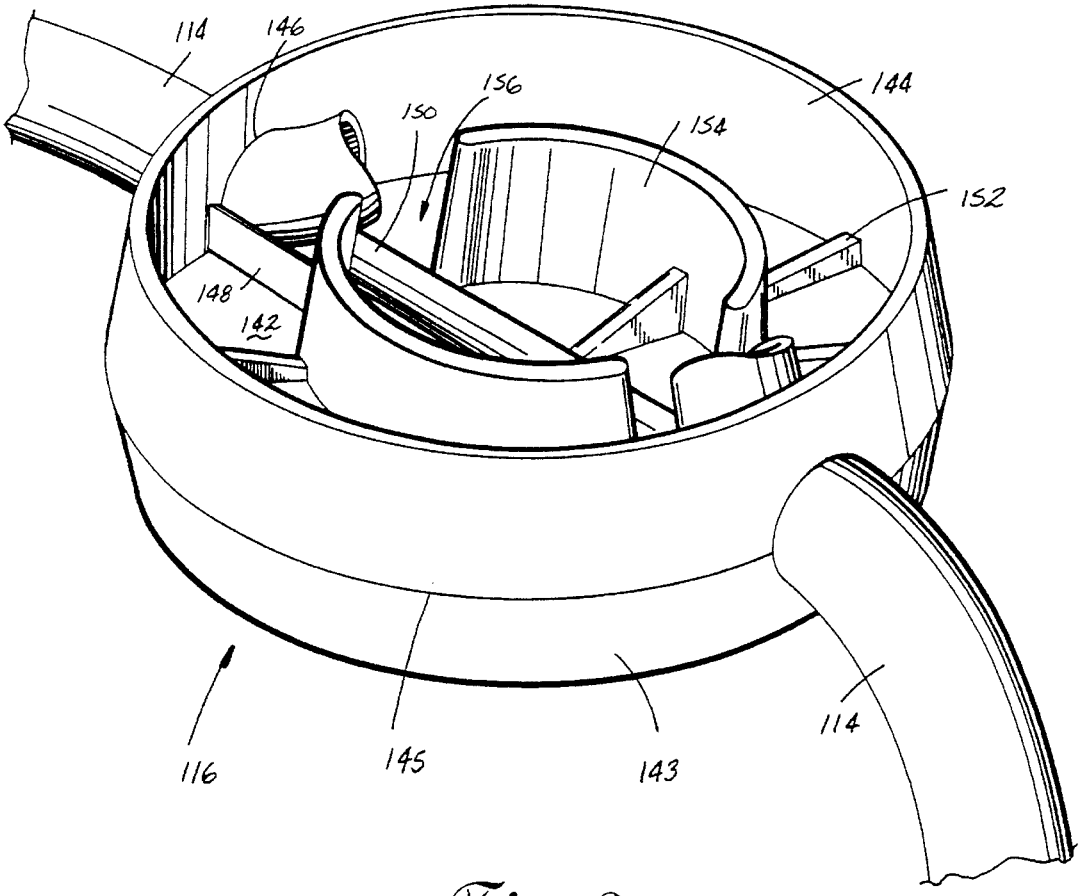
FIG. 3 is a cross-sectional view of an adjustable knee pad of the exercise apparatus of FIG. 1 taken along line 3—3 of FIG. 1 with a portion of elastic tubing shown broken away for clarity.

The knee pads 116 are molded of a soft rubber or other elastomeric material. As illustrated in the underside view of one of the knee pads 116 illustrated in FIG. 3, each knee pad 116 has a discoid shape with a circular upper panel 142 having a cylindrical side panel 144 depending from the periphery thereof. An outer surface 143 of the side panel 144 bulges outwardly slightly to form an annular apex 145, thereby stiffening the side panel 144. The knee pad channel 120 comprises apertures 146 through the side panel 144, which are spaced 180° apart, and a large rib 148 extending across the upper panel 142 between the apertures 146. A semi-circular shaped trough 150 forms the lower surface of the rib 148 and is shaped to accommodate the elastic tubing 114. Radial stiffening ribs 152 extend radially inwardly from the side panel 144 across portions of the upper panel 142. A discontinuous cylindrical inner stiffening rib 154 depends from the upper panel 142 and is concentric with the side panel 144. The inner stiffening rib 154 has interruptions aligned with the apertures 146. The elastic tubing 114 passes through the apertures 146 and interruptions 154 and is received within the trough 150. Preferably, the elastic tubing fits snugly within the apertures 146 whereby the knee pads 116 tend to remain at a fixed position upon the elastic tubing 114, but can be moved longitudinally along the elastic tubing 114 if desired. Pressure from a user's knees upon the knee pad 116 tends to compress the elastic tubing 114 between the rib 148 and base plate upper surface 126 (see FIG. 1) to fix the position of the knee pad 116 upon the elastic tubing 114 during use of the exercise apparatus 100.

Figure 4:
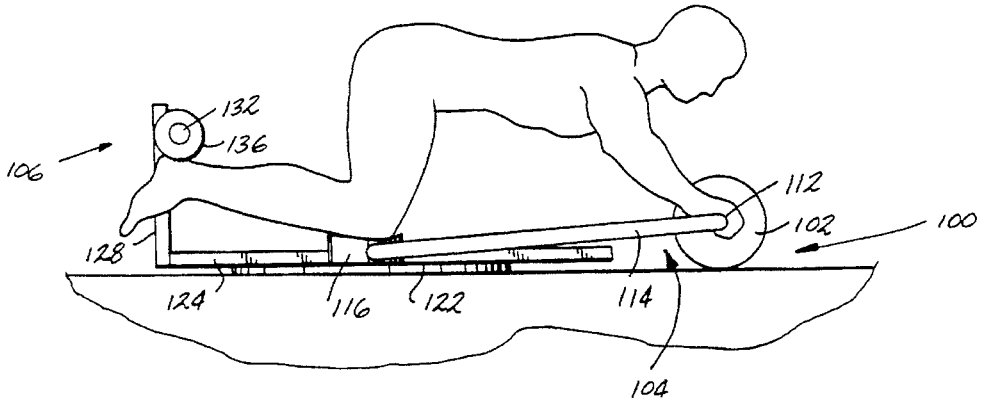
FIG. 4 is a side elevational view of an individual using the exercise apparatus of FIGS. 1–3 in the initial, kneeling position.
Figure 5:
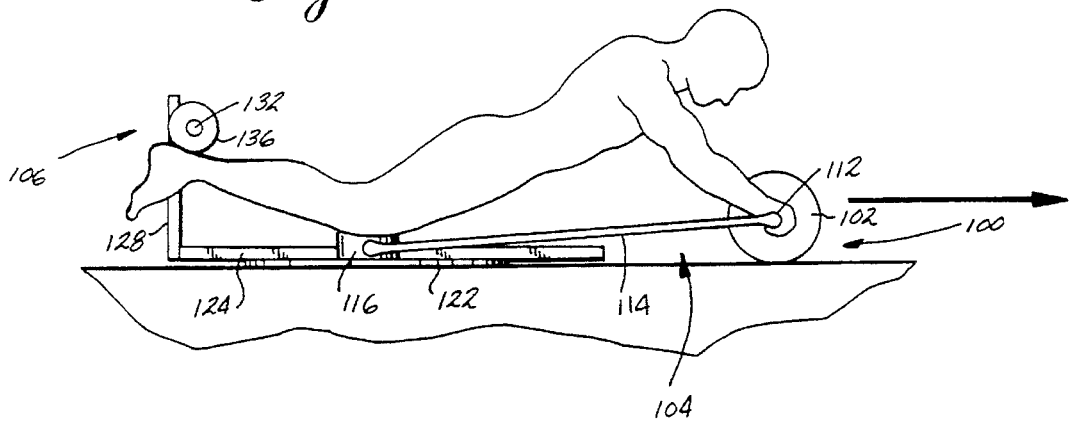
FIG. 5 is a side elevational view of an individual using the exercise apparatus of FIGS. 1–3 as the individual begins to push the wheeled roller forward.
Figure 6:
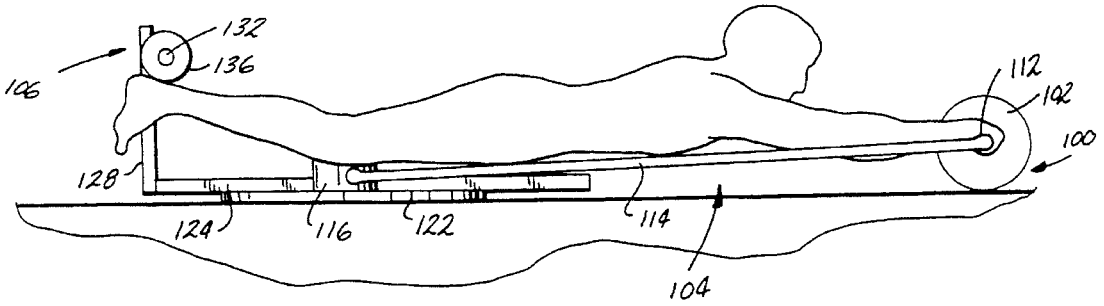
FIG. 6 is a side elevational view of an individual using the exercise apparatus of FIGS. 1–3 in the prone, fully extended position.
Figure 7:
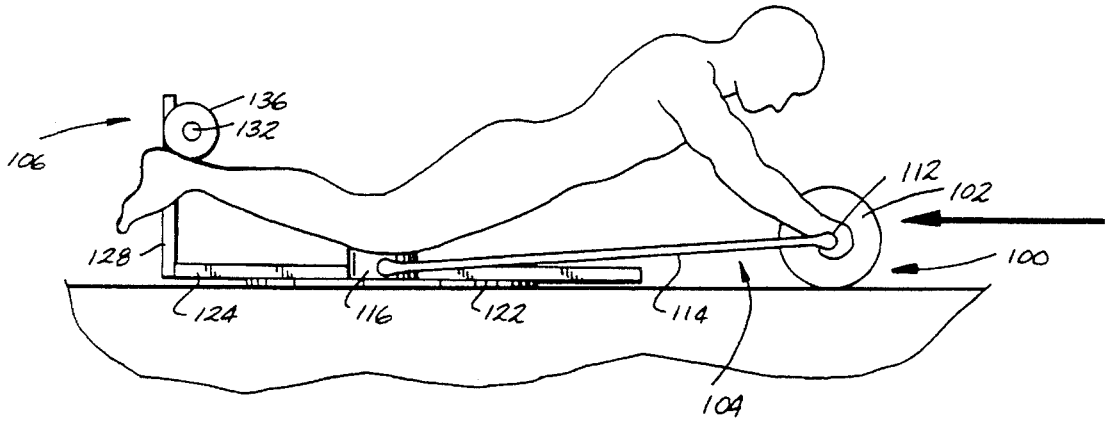
FIG. 7 is a side elevational view of an individual using the exercise device of FIGS. 1–3 as the individual returns from the prone position to the initial kneeling position.

As seen in FIGS. 4 through 7, a user begins the exercise by placing the knee pads 116 upon the base plate 122 and kneeling upon the knee pads 116. The user then locks his or her heels underneath the heel bar 132 and grasps the hand grips 112 on the wheeled roller 102. The weight of the user upon the base plate 122 stabilizes the heel brace apparatus 106, and the weight of the user upon the knee pads 116 clamps the elastic tubing 114 within the knee pad channels 120 to lock their position upon the elastic tubing 114. From the kneeling position illustrated in FIG. 4, the user rolls the wheeled roller 102 forward away from the knees as illustrated by the intermediate position of FIG. 5. The user completes the first half of the exercise by continuing to roll the wheeled roller 102 forwardly until prone with arms extended as illustrated in FIG. 6. The user completes the exercise by rolling the wheeled roller 102 backwards, returning from the fully prone position to the kneeling position as illustrated in FIGS. 7 and 4. The user is assisted in returning to the kneeling position by the elasticity of the elastic tubing 114.

The user can vary the muscle groups exercised by applying more or less pressure against the heel bar 132. Less pressure against the heel bar 132 exercises the anterior portion of the body, primarily the abdominal muscles, and increased pressure against the heel bar increases the exercise upon muscles in the posterior portion of the body and legs, primarily the hamstring, gluteal and latissimus muscle groups. Although the wheeled roller 102 and elastic member 104 can be used in a similar exercise without the heel brace apparatus 106, use without the heel brace apparatus 106 restricts the exercise primarily to the abdominal and arm muscles.

Figure 8:
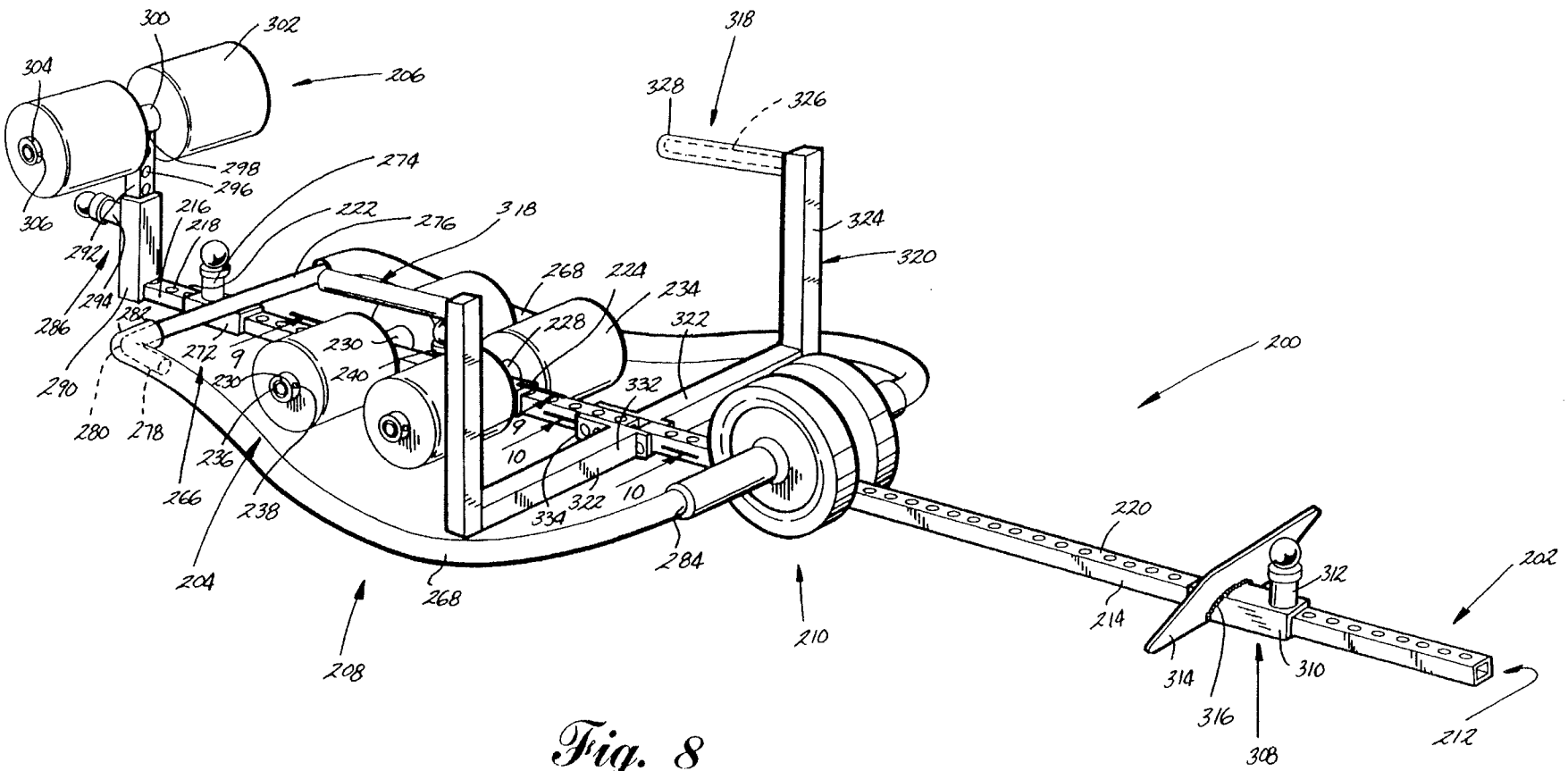
FIG. 8 is a perspective view of a second embodiment of an exercise apparatus according to the invention.

FIG. 8 illustrates a second embodiment of an exercise apparatus 200 according to the invention, which is formed as a single unit and which provides for easier entrance into the starting position for the exercise. The exercise apparatus 200 comprises in general a frame 202 supporting a knee rest 204, and a heel brace 206. An elastic return assembly 208 extends between a wheeled roller 210 and the frame 202. The frame 202 comprises an elongated, longitudinally extending, horizontal frame member 212 comprising a forward bar 214 and a rearward bar 216 pivotally connected to one another for folding the exercise apparatus 200 into a more compact form for storage and transportation thereof, as will be more fully described hereinafter.

Figure 9:
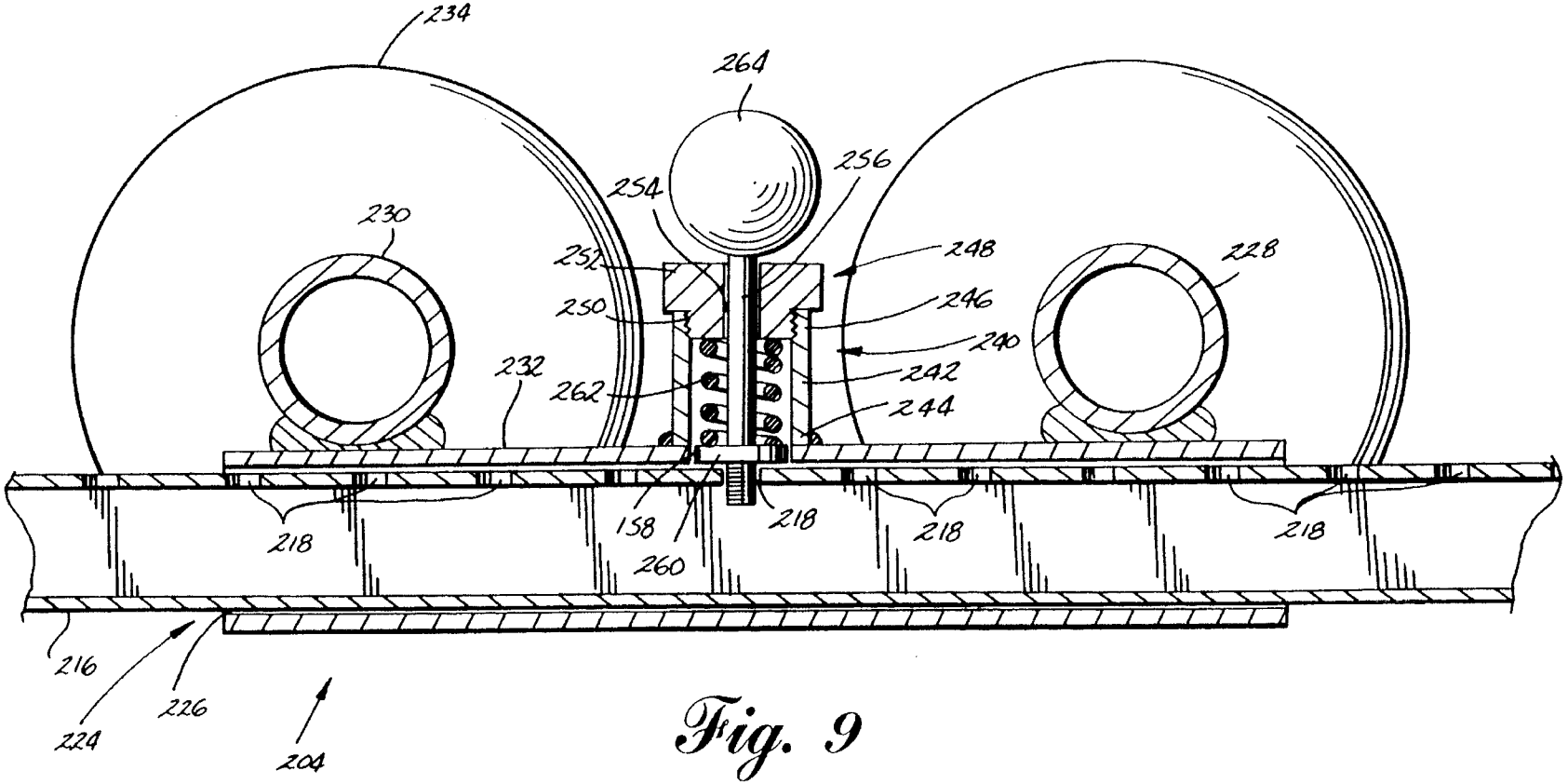
FIG. 9 is a sectional view of a slidable adjustment for a knee rest taken along line 9—9 of FIG. 8.

The knee rest 204 slidably mounts to the rearward bar 216. Each of the forward and rearward bars 214 and 216 comprise tubular square crosssectioned channel members, preferably of low carbon steel, having a plurality of longitudinally aligned apertures 218 along an upper surface 220 and 222, thereof, respectively. As also illustrated in FIG. 9, the knee rest 204 comprises a short channel member 224 having a coaxial bore 226 therethrough of complementary internal dimensions to the external dimensions of the rearward bar 216, whereby the channel member 224 is slidably received upon the rearward bar 216 and longitudinally adjustable thereon. Forward and rearward lateral bars 228 and 230 affix to an upper surface 232 of the channel member 224 and extend laterally, horizontally from each side of the channel member 224 and parallel to each other. A cylindrical foamed cushion pad 234 is received on each end of both the forward and rearward lateral bars 228 and 230 and is held thereon by a collet 236 and set screw 238 as in the previous embodiment.

The knee rest channel member 224 slides longitudinally along the rearward bar 216 to adjust the longitudinal position of the knee rest 204. A pop pin 240 releasably fixes the longitudinal position of the knee rest 204 upon the rearward bar 216. The pop pin 240 comprises a cylindrical housing 242 having one end 244 affixed to the channel member upper surface 232, whereby the housing 242 extends outwardly from and normal to the channel member upper surface 232. A second end of the channel member 246 is open and threadably receives a fitting 248. The fitting comprises a threaded portion 250 which threads into the housing open end 246, an outwardly extending annular flange 252 which abuts the housing open end 246, and a central aperture 254 therethrough. A locking pin 256 enters the housing 242 through the fitting aperture 254, extends coaxially through the housing 242, and passes out of the housing 242 and into the channel member coaxial bore 226 through an aperture 258 in the channel member upper surface 232.

The locking pin 256 carries an annular collar 260 which is received within the housing 242. A coiled compression spring 262 operates between the fitting 248 and the collar 260 to bias the locking pin 256 into the channel member coaxial bore 226. A spherical handle ball 264 on the outer end of the locking pin 256 limits the inward movement of the locking pin 256, and provides a convenient grasping location for a user to manually overcome the bias of the spring 262 and pull the locking pin 256 out of the channel member coaxial bore 226.

To reposition the longitudinal position of the knee rest 204 upon the rearward bar 216, a user grasps the ball 264 and pulls the locking pin 256 upwardly out of one of the apertures 218 in the rearward bar 216, and slides the knee rest channel member 224 longitudinally along the rearward bar 216 to the new desired position. After the knee rest 204 is properly positioned, the user releases the handle 264 and allows the locking pin 256 to move inwardly under the bias of the spring 262 back into the channel member interior bore 226 and into one of the rearward bar apertures 218 corresponding to the new location. The pop pin 240 thus provides a convenient method for releasably fixing the longitudinal position of the knee rest 204.

Returning to FIG. 8, the elastic return assembly 208 comprises an adjustable attachment member 266 and two sections of elastic tubing 268. The attachment member 266 comprises a channel member 272 coaxially receiving the rearward bar 216 and having a pop pin 274 and a laterally extending bar 276. The channel member 272 with the pop pin 274 and laterally extending bar 276 is constructed in the same fashion as the knee rest channel member 224, knee rest pop pin 240, and knee rest forward lateral bar 228. However, outer ends 278 of the laterally extending bar 276 are bent forwardly in a radius curve 280. One end 282 of each elastic tubing section 268 telescopically receives the bar ends 278. Preferably, the elastic tubing ends 282 are pushed onto the bar 276 beyond the curve 280. As in the previous embodiment, an evaporating lubricating fluid, such as alcohol, may be used to ease the tubing ends 282 onto the bar ends 278. Opposite ends 284 of the elastic tubing affix to the wheeled roller 210 as in the previous embodiment, and the wheeled roller 210 has the same structure as the wheeled roller 102 of the previous embodiment. The tension in the elastic member 208 during exercise can be adjusted by adjusting the longitudinal position of the attachment member 266 upon the rearward bar 216.

The heel brace 206 comprises a vertical riser 286 extending upwardly from a rear end 288 of the rearward bar 216. The vertical riser 286 comprises two sections, a lower section 290 comprises a tubular square channel member affixed to the rear bar rear end 288, and a second section 292 comprises a square tubular channel telescopically received within the first section 290. A pop pin 294 extends outwardly from the first section 290, and the second section 292 has a plurality of longitudinally aligned apertures 296 for engagement by the pop pin 294, whereby the height of an upper end 298 of the second section 292 can be adjusted and fixed. A lateral bar 300 extends outwardly, laterally from the second section upper end 298. Cylindrical foam pads 302 are received upon the ends of the lateral bar 300 and retained thereon by collets 304 having set screws 306 which are received upon outer ends of the lateral bar 300.

The forward bar 214 carries an adjustable stop 308 to limit forward motion of the wheeled roller 210 if desired by the exerciser. The adjustable stop 308 comprises a channel member 310 having a pop pin 312 and a rectangular plate 314 having a square aperture 316 therethrough, the aperture receiving the channel member 310. The plate 314 is affixed to the channel member 310, as by welding, and slopes upwardly and away from the knee rest 204. The adjustable stop 308 is thus longitudinally adjustable along the forward bar 214 in the same fashion as the knee rest 204 adjusts along the rearward bar 216.

A pair of handrails 318 ease a user's entry into the exercise apparatus 200. Each handrail 3 18 is supported on a L-shaped frame 320 having a lateral member 322 extending outwardly from and transverse to the horizontal frame member 212 and a vertical member 324 extending upwardly from an outward end of the lateral member 322. The handrails 318 comprise a cylindrical member 326 affixed to an upper portion of the vertical member 324 and extending horizontally rearwardly therefrom. A tubular pad 328, of much narrower diameter than the pads 302 or 234, coaxially receives the cylindrical member 326 to provide a comfortable gripping surface for the user. Plugs (not shown) may be fitted into outward ends of the cylindrical members 326 to hold the pads 328 thereon.

Figure 10:
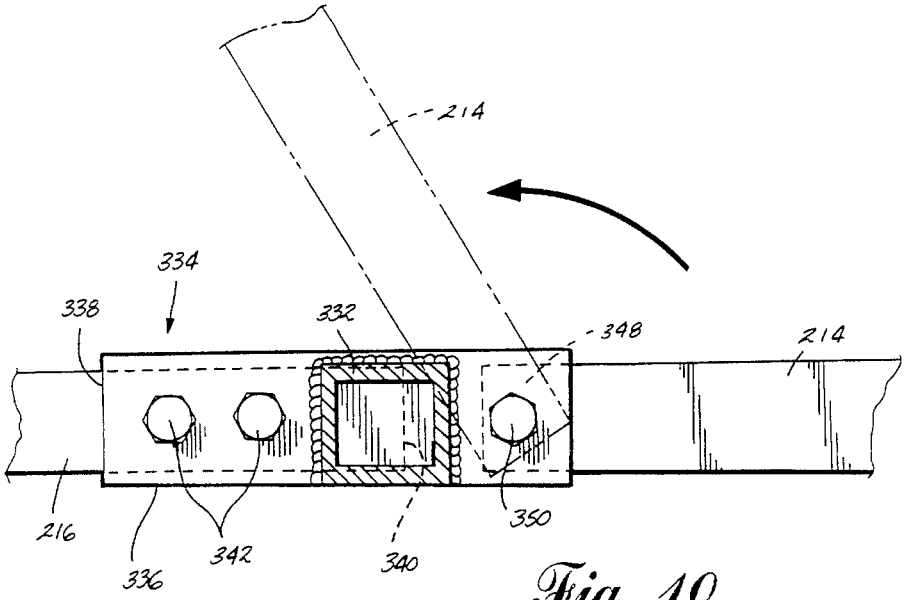
FIG. 10 is a section view of an interconnection between forward and rearward segments of the exercise apparatus of FIG. 8, taken along line 10—10 of FIG. 8.
Figure 11:
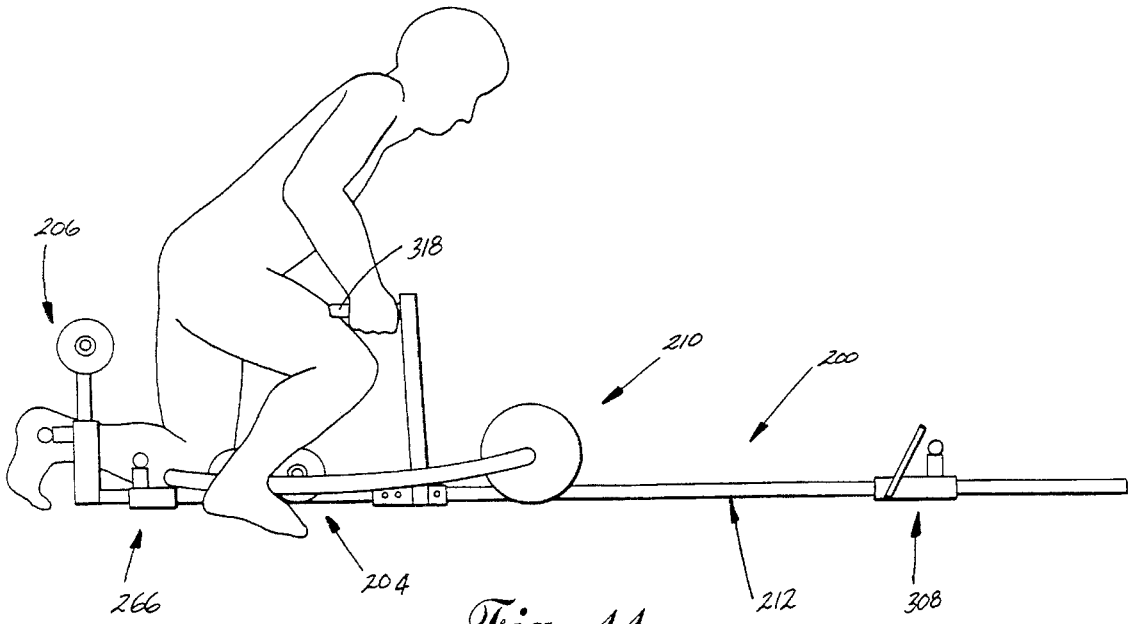
FIG. 11 is a side elevational view of an individual using handrails to enter the exercise apparatus of FIG. 8.

As also illustrated in FIG. 10, inner ends 332 of the lateral members 322 affix to a short C-channel 334. The C-channel comprises a horizontal lower wall 336 and side walls 338 extending vertically upwards from lateral outside edges of the lower wall 336. The lateral member inner ends 332 affix to the C-channel side walls 338, as by welding. Two bolts 342 pass through the C-channel side walls 338 and a forward end 340 of the rearward bar 216, whereby the rearward bar forward end 340 is fixedly received between the C-channel side walls 338 upon the C-channel lower wall 336. A rearward end 348 of the forward bar 214 is also received within the C-channel 334 and affixes thereto by a single bolt 350 passing through the C-channel side walls 338 and forward bar rearward end 348. Accordingly, the forward bar 214 may be pivoted upwardly and rearwardly about the bolt 350 for convenient storage of the exercise apparatus 200 as illustrated in FIG. 10.

Figure 12:
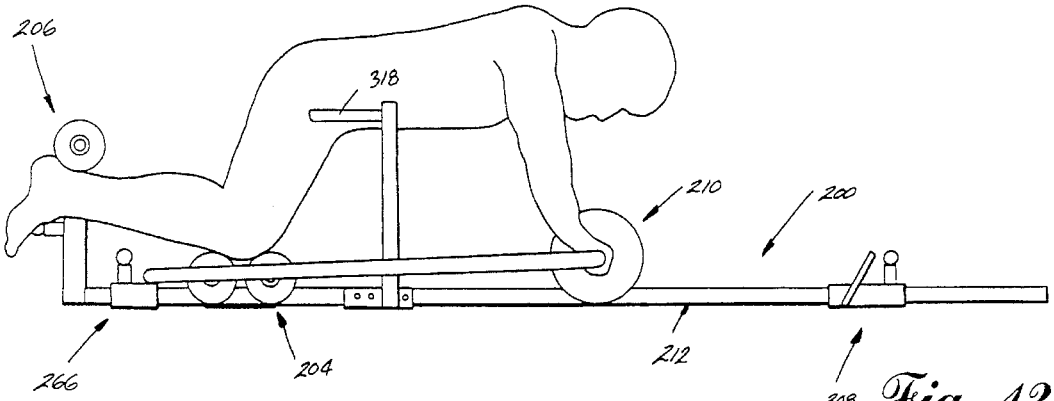
FIG. 12 is a side elevational view of an individual using the exercise apparatus of FIG. 8, the individual being in the initial, kneeling position.

FIGS. 11 through 14 illustrate use of the exercise apparatus 200. An exerciser uses the exercise apparatus 200 in essentially the same fashion as the exercise apparatus 100 of the previous embodiment. However, the exercise apparatus 200 provides several advantages and increased flexibility to the exerciser. The handrails 318 ease the user's entry onto the knee rest 204 as illustrated in FIG. 12. The user may adjust the vertical position of the heel brace 206 and the horizontal position of the knee rest 204 to accommodate the user's leg length in a comfortable fashion. The user may also adjust the longitudinal position of the attachment member 266 to increase or decrease the resistance provided by the elastic member 208. For some users, particularly a user having experienced a recent injury to the lower back area, it may be desirable to prevent the user from achieving a full prone position during the exercise. In such case, the adjustable stop 308 can be positioned longitudinally along the horizontal frame member 212 to limit the forward movement of the wheeled member 210.

Figure 13:
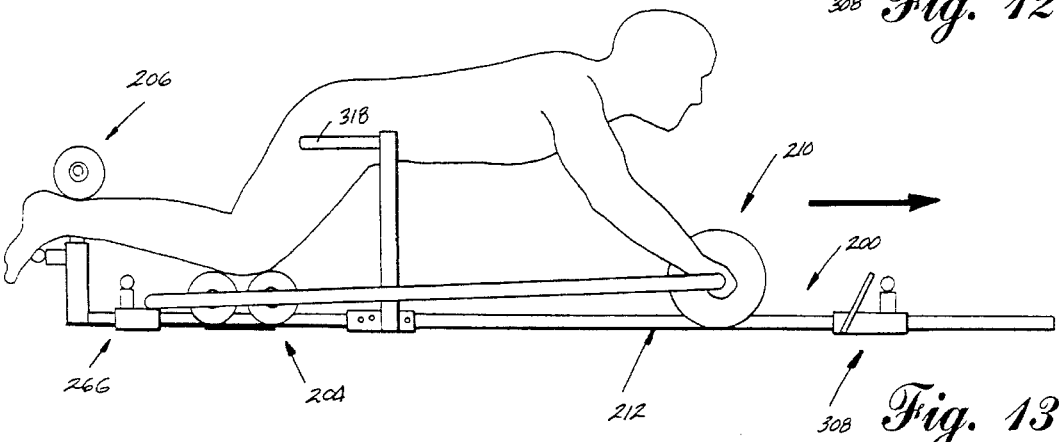
FIG. 13 is a side elevational view of an individual using the exercise device of FIG. 8 as the individual begins to push the wheeled roller forward.
Figure 14:
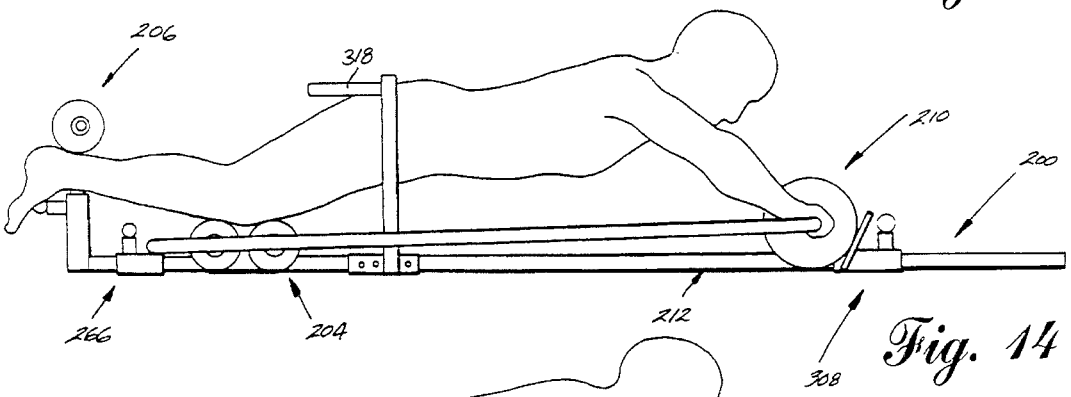
FIG. 14 is a side elevational view of an individual using the exercise device of FIG. 8 in the prone, fully extended position.
Figure 15:
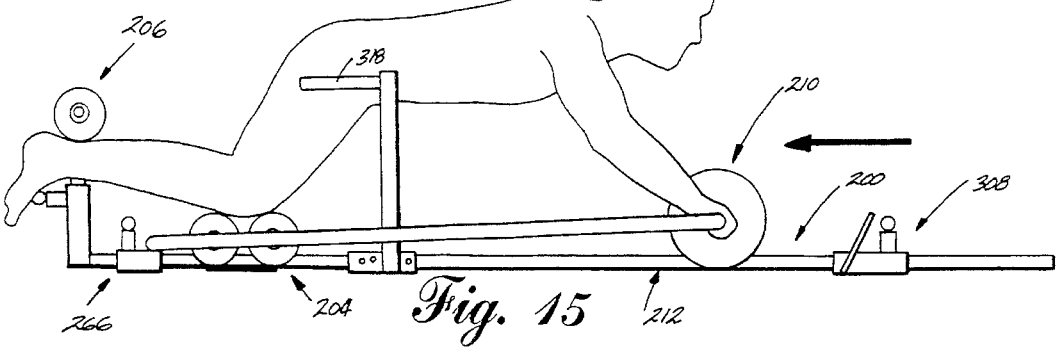
FIG. 15 is a side elevational view of an individual using the device of FIG. 8 returning from the prone position to the initial kneeling position.

After a user has made the appropriate adjustments to the exercise apparatus 200 and entered the exercise apparatus 200 with assistance from the handrails 318, the user assumes a kneeling position as illustrated in FIG. 12, with knees upon the knee rest 204, ankles behind the heel brace 206, and hands upon the wheeled roller 210. From the kneeling position, the user pushes the wheeled roller 210 forwardly as illustrated in FIG. 13. The user continues pushing the wheeled roller 210 forwardly until the wheeled roller 210 abuts the adjustable stop 308, or the user has achieved a fully prone position as illustrated in FIG. 14. From the forward extension, the user returns to the kneeling position as illustrated in FIG. 15 and FIG. 12.

Although a preferred use of the exercise devices 200 and 100 is with the use of the elastic return assembly 208 or the elastic tubing 114, respectively, the invention also contemplates the use of either exercise apparatus without such elements. The user can simply use the wheeled rollers 210, 102 without the elastic tubes and return to the start position with his or her own power. The heel brace 206 and heel brace assembly 106 provide the necessary support or assist the user in extending outwardly and returning to the kneeling position. In a similar vein, the invention is not limited to a wheeled roller, such as the wheeled rollers 102 and 210 illustrated herein, for assisting the forward and rearward motion of the user. In fact, the exercise can be performed by a user without the aid of any support for the hands. In such instance, the user can walk out and back with his or her hands, or if in particularly strong physical condition, perform the exercise without the aid of his or her arms. Preferably, some form of gliding support, such as the wheeled rollers 102 and 210, is provided for the user's arms to promote smooth forward and rearward motion of the torso. For instance, the gliding support can comprise a sliding track, which preferably employs bearings or a slick gliding surface to smoothly glide the track back and forth, or even possibly, a pendulum support for the user's arms.

A method for performing an exercise is contemplated in which a user braces his or her heels against a heel brace, such as the heel braces 106 or 206 illustrated herein, which restrains upward movement of the heels and rests his or her knees upon a support surface. Preferably, the support surface is padded and interconnected to the heel brace to stabilize the heel brace, as illustrated herein in FIGS. 1 and 8. However, the exercise can be performed with a heel brace affixed directly to the support surface, and hardy exercisers may desire to forego padding for their knees, especially if the support surface is soft, such as a carpeted floor. From a forward kneeling position, with knees on the support surface and heels restrained by the heel brace, the user moves his or her torso forwardly. Preferably, the user employs a support, such as the wheeled rollers 102 or 210, to smoothly move his or her hands forwardly during the exerciser. However, as previously described, exercisers in particularly strong physical condition may perform the exercise without supporting their torso with their arms. During the forward movement of the torso, the user braces his or her heels against the heel brace and uses muscles in the legs, buttocks and back to support the torso now cantilevered out from the knees.

The user can continue forward movement of the torso until fully prone, preferably without resting his or her torso upon the supporting surface in the prone position, or stop the forward movement somewhat short of the prone position. To aid in consistently stopping forward movement at a constant position short of fully prone, some form of stop, such as the stop 308 illustrated in FIG. 8, may be employed. From the forwardmost extent of the user's movement, the user returns to the forward keeling position. During the movement, the user preferably uses the leg, buttocks and back muscles to support his or her torso, with pressure applied against the heel brace. Also preferably, the user employs a resistance member, such as the elastic member 104 of FIG. 1, to restrain the forward movement, and assist the rearward movement.

While particular embodiments of the invention have been shown, it will be understood that the invention is not limited thereto since modification can be made by those skilled in the art, particularly in light of the foregoing teachings. Reasonable variation and modification are possible within the foregoing disclosure of the invention without departing from its true spirit and scope. For instance, it will be appreciated that other adjustable locking mechanisms may be substituted for the pop pins. Also, pads other than the cylindrical pads disclosed in the foregoing teachings may be provided for the knee rest, ankle lock, and hand grips. However, the particular arrangement of the knee rest 204 provides a particular advantage. The spacing of the pads cradles the kneecap whereby the pressure on the knees is taken by the sturdier femur and tibia bones. Other forms of stops may be provided to limit the forward extension of an exerciser. For instance, a tether could be attached to the wheeled roller 210 to limit its forward extension. Also, it will be appreciated that the heel brace can mount directly to a support surface, such as a floor, and a user may perform the exercise with heels under the heel brace, knees upon the floor, and preferably using a wheeled roller or other gliding support. While the invention has been particularly described in connection with certain specific embodiments thereof, it is to be understood that this is by way of illustration and not of limitation, and the scope of the appended claim should be construed as broadly as the prior art will permit.

The embodiments of the invention in which an exclusive property right or privilege is claimed are defined as follows:

1. An exercise device having:

a glide for supporting arms of a user in a forward kneeling position and gliding along a support while extending the body in a forward direction;

a heel brace adapted to be positioned behind and bear against the rear surface of the heels of a user for restraining upward movement of the heels of a user in a forward kneeling position and as the user pushes the glide in the forward direction;

a knee rest for supporting knees of a user in a forward kneeling position as the user glides the glide in the forward direction; and a connector between the knee rest and the heel brace to maintain the heel brace and the knee rest in a relatively fixed position, at least while the user rests his or her knee on the knee rest and pushes the glide in the forward direction;

whereby as the user pushes the glide in the forward direction, with knees on the knee rest and heels abutting the heel brace, the user can use at least one of back, buttock and leg muscle groups to extend and support his or her body and return his or her body to the kneeling position.

2. An exercise device according to claim 1 and further comprising a biasing element between the glide and the connector to resist the movement of the glide in the forward direction and to assist the user in returning to the forward kneeling position.

3. An exercise device according to claim 2 and further comprising a bias element mounting between the biasing element and the connector for adjustably mounting the biasing element to the connector.

4. An exercise device according to claim 2 wherein the biasing element comprises at least one elastic band, and the glide comprises a wheeled roller.

5. An exercise device according to claim 2 and further comprising an adjustable mounting between the knee rest and the connector wherein the relative distance between the knee rest and the heel brace is adjustable.

6. An exercise device according to claim 5 wherein the connector comprises a horizontally extending frame member and the adjustable mounting mounts the knee rest on the frame member for selective movement along the frame member.

7. An exercise device according to claim 5 wherein the heel brace comprises a vertical riser and a horizontally oriented heel receiving bar on the riser so that the heel receiving bar is above the support surface.

8. An exercise device according to claim 7 wherein the riser has a vertical adjustment member to selectively raise and lower the heel receiving bar with respect to the support surface.

9. An exercise device according to claim 7 wherein the connector comprises a frame member which extends laterally from the riser and the adjustable mounting mounts the knee rest on the frame member for selective movement along the frame member.

10. An exercise device according to claim 1 and further comprising an adjustable mounting between the connector and at least one of the heel brace and the knee rest so that the relative distance between the heel brace and the knee rest is adjustable.

11. An exercise device according to claim 10 wherein the heel brace comprises a vertical riser and a horizontally oriented heel receiving bar on the riser so that the heel receiving bar is above the support surface, and the riser has a vertical adjustment member to selectively raise and lower the heel receiving bar with respect to the support surface.

12. An exercise device according to claim 11 wherein the connector comprises a frame member which extends laterally from the riser and the knee rests are adjustably mounted on the frame member for selective movement along the frame member.

13. An exercise device according to claim 12 and further comprising a plate extending laterally from the frame member and wherein the knee rests comprise pads resting atop the plate.

14. An exercise device according to claim 1 wherein the heel brace comprises a vertical riser, a horizontally oriented heel receiving bar on the riser so that the heel receiving bar is above the support surface, and cylindrical pads mounted on the heel receiving bar whereby when a user braces his or her heels against the heel brace the pads provide comfort.

15. An exercise device according to claim 1 wherein the knee rests comprise spaced apart front and rear bars, each of the front and rear bars being affixed to the connector and extending laterally therefrom, and cylindrical pads received upon the front and rear bars whereby a user's knee can be received atop the pads and between the front and rear bars while the user is in the forward kneeling position and gliding the glide along the support surface in a forward or rearward direction.

16. An exercise device according to claim 15 wherein the connector comprises a frame member which extends laterally from the heel brace to the knee rests.

17. An exercise device according to claim 1 wherein the knee rest comprises pads resting atop the connector for receipt of a user's knees.

18. An exercise device according to claim 17 and further comprising an elastic band passing through openings in the knee pads, the openings being sized to allow the knee pads to be adjusted along the elastic band, and the elastic band being affixed to the glide whereby the elastic band resists movement of the glide in the forward direction and assists the user in returning to the forward kneeling position.

19. An exercise device according to claim 1 and further comprising at least one handrail affixed to the connector and having a gripping portion elevated above the support surface whereby a user can grasp the handrail and ease his or her entry into the forward kneeling position on the knee rest.

20. An exercise device according to claim 1 wherein the connector comprises an elongated bar extending forwardly of the knee rest and further comprising an adjustable stop member adjustably mounted on the elongated bar for limiting forward movement of the glide, whereby a user can affix the stop member in a position to limit his or her forward movement short of a fully prone position and thereby reduce stress upon muscles in the back.

* * * * *

UNITED STATES PATENT AND TRADEMARK OFFICE

CERTIFICATE OF CORRECTION

PATENT NO. : 5,499,961
DATED : March 19, 1996
INVENTOR(S) : Ernest M. Mattox

It is certified that error appears in the above-identified patent and that said Letters Patent is hereby corrected as shown below:

Column 11, claim 1,
Line 5, "support while" should read -- support surface while --

Column 11, claim 9,
Line 59, "rest" should read -- rests --

Signed and Sealed this

Nineteenth Day of February, 2002

*Attest:*

*Attesting Officer*

JAMES E. ROGAN
*Director of the United States Patent and Trademark Office*